United States Patent [19]

Berneke

[11] 4,359,805

[45] Nov. 23, 1982

[54] WINDOW SASH HINGE

[75] Inventor: Erik S. Berneke, Copenhagen, Denmark

[73] Assignee: V. Kann Rasmussen Holding A/S, Søborg, Denmark

[21] Appl. No.: 278,427

[22] Filed: Jun. 29, 1981

[30] Foreign Application Priority Data

Jul. 8, 1980 [DK] Denmark ..... 2943/80

[51] Int. Cl.[3] ..... E05D 7/086

[52] U.S. Cl. ..... 16/364; 16/347

[58] Field of Search ..... 16/379, 364, 363, 371, 16/347

[56] References Cited

FOREIGN PATENT DOCUMENTS

| | | |
|---|---|---|
| 1060743 | 7/1959 | Fed. Rep. of Germany . |
| 1559843 | 9/1969 | Fed. Rep. of Germany . |
| 302261 | 10/1968 | Sweden . |
| 1028251 | 5/1966 | United Kingdom . |
| 1441789 | 7/1976 | United Kingdom ..... 16/347 |

*Primary Examiner*—Werner H. Schroeder
*Assistant Examiner*—A. Falik
*Attorney, Agent, or Firm*—Lane, Aitken, Kice & Kananen

[57] ABSTRACT

In a tiltable window, especially to be mounted in a sloping roof, the lateral members of the sash and frame carry external cover rail sections which in the closed position of the window overlap each other in the area of the hinge device of the window. The hinge device consists of a frame part and a sash part and of an intermediate part connected with each of the two parts by means of two parallel pivot pins which in the closed position of the window are situated within the outer side of the window and are protected by the cover rail sections. During the opening movement of the sash, its hinge part is first rotated in relation to the intermediate part while this part is locked to the frame part by means of a latch, and after the forcedly controlled release of the latch, the sash part and the intermediate part together can rotate further in relation to the frame part. During the first part of the rotation, an edge recess provided in the intermediate part gives room for the upper end of the cover rail section of the sash which thereby is disengaged from the lower end of the cover rail of the frame.

5 Claims, 10 Drawing Figures

WINDOW SASH HINGE

FIELD AND BACKGROUND OF THE INVENTION

In tiltable windows to be mounted in a sloping roof, the joints between the lateral members of the sash and frame are usually covered with cover rails, each comprising an upper section secured to the frame and a lower section secured to the movable sash, and in order to achieve a sufficient tightness in the particularly critical area of the hinge mountings, the two sections generally overlap each other over a suitable distance in the closed position of the window. To make this possible, the movement of the window sash, at any rate in the vicinity of its closed position, takes place as a swinging about an axis spaced outwardly from the window and at a distance therefrom depending on the desired degree of overlapping and on the distance between the cover rail sections in the overlapping area. The axis can be established by means of pivot pins interconnecting protruding parts of the frame and the sash, respectively, but this is generally best avoided, inter alia because the parts and pins in question would be exposed to climatic influences; it has been found preferable instead to establish the axis by means of mountings built into the frame and sash and having associated arc-shaped sliding rails and guides.

A known hinge device of this type, see e.g. British Patent Specification No. 1,028,251, comprises a frame part having an arc-shaped guide firmly secured to a base plate, and an associated sash part having a base plate which through a pivot pin is swingably connected with a bowl-shaped sector, the edge portion of which constitutes the sliding rail cooperating with the guide of the frame part. At the beginning of the opening movement of the window, the sliding rail is displaced in the guide until the pivot pin is positioned clearly outside the plane formed by the outer side of the frame, whereafter the further opening movement takes place by swinging of the sash about this pivot pin.

Regardless of the manner in which the externally positioned pivotal axis for the initial opening movement of the sash is established, it must in practice necessarily be placed at some distance, in horizontal direction, from the horizontal axis of gravity of the sash, for which reason the sash when released from its closed position will tend to move towards the position in which its axis of gravity is positioned vertically under the pivotal axis. This tendency can be counteracted by providing a suitable friction between the guiding surfaces sliding on each other, but such friction will, for one thing, obstruct the opening and the closing of the window in other situations and, for another thing, it will generally now and then require some adjustment on account of variations due to wear, dirt and the like.

OBJECT AND SUMMARY OF THE INVENTION

The present invention has for its object to provide a hinge device for tiltable windows that makes it possible to avoid these drawbacks which, although acceptable in practice, still cause some trouble, the hinge device being at the same time of a simple and robust construction.

More specifically, the invention relates to a hinge device for tiltable windows having external cover rails positioned on the frame of the window and its sash, respectively, and overlapping each other at the hinge area in the closed position of the window, said hinge device—like the known one referred to—comprising two parts intended for being firmly secured to the frame and the sash, respectively, and an intermediate part connecting these frame and sash parts, the sash part during the movement of the sash from its closed position being successively pivotable in relation to the frame part about two different axes, one of which defines a rotation of the intermediate part in relation to the frame part, while the other defines a rotation of the sash part in relation to the intermediate part. The characteristic feature of the hinge device according to the invention is that the two axes are constituted by two pivot pins connecting the intermediate part with the frame part and the sash part above and below, respectively, an edge recess provided in the intermediate part and giving room for the overlapping end of the sash cover rail, when the sash part is rotated in the opening direction in relation to the intermediate part, the intermediate part being, during the tilting of the sash away from its closed position, held against rotation in relation to the frame part until the rotation of the sash part in relation to the intermediate part has been terminated.

While the above-mentioned overlapping of the cover rails in the known hinge device is established in the way that, owing to the position of the pivot axis outside the external side of the window, the upper end portion of the sash rail section during the last part of the closing movement of the sash slides upward beneath the lower end portion of the frame rail section and approximately parallel thereto, the corresponding movement of the sash of a window provided with a hinge device according to the present invention is a rotation on the pivot pin connecting the intermediate part with the sash part and disposed, in this situation, inside the external side of the window. As a result thereof, the overlapping end of the sash rail section is tilted or swung upward towards the under side of the overlapping end of the frame rail section, possibly into direct abutment thereon, so that even severe deformations of the overlapping ends in question will not impede the movement of the sash in the vicinity of its closed position. In return, the thickness of the frame must give room for the swinging movement to be carried out by the overlapping end of the sash rail section, but this requirement is easily fulfilled by the edge recess provided in the intermediate part.

A particular advantage of the hinge device according to the present invention is that the axis of the pivot pin between the sash part and the intermediate part may coincide with the horizontal axis of gravity of the window sash or be spaced at any short distance therefrom, so that the sash can be in neutral equilibrium about the axis of the pin. Consequently, no increased friction is required to counteract an undesirable movement of the sash by gravity but it may, however, be suitable to provide a certain degree of friction in order to avoid any undesirable movement of the sash caused by gusts of wind and draught as well as a movement between the sash part and the intermediate part after the release of the latter from the frame part. In other words, one should make sure that a rotation about both pins will not take place at the same time, i.e. a rotation of the intermediate part in relation to the frame part and of the sash part in relation to the intermediate part, as the sash part could thereby occupy a position making it impossible to close the window again.

Accordingly, a particular embodiment of the hinge device is characterized in that the sash part and the intermediate part are in permanent mutual surface contact in at least one plane at right angles to their mutual rotation axis. Apart from the fact that this surface contact has a stabilizing effect on the hinge device, it has no influence on the guiding of the mutual movement of the parts, and thus a clear distinction has been provided between the friction surfaces and the guiding surfaces, so that they can both be given the most suitable design according to their sole function.

DETAILED DESCRIPTION OF THE PREFERRED EMBODIMENT

Figure 1:
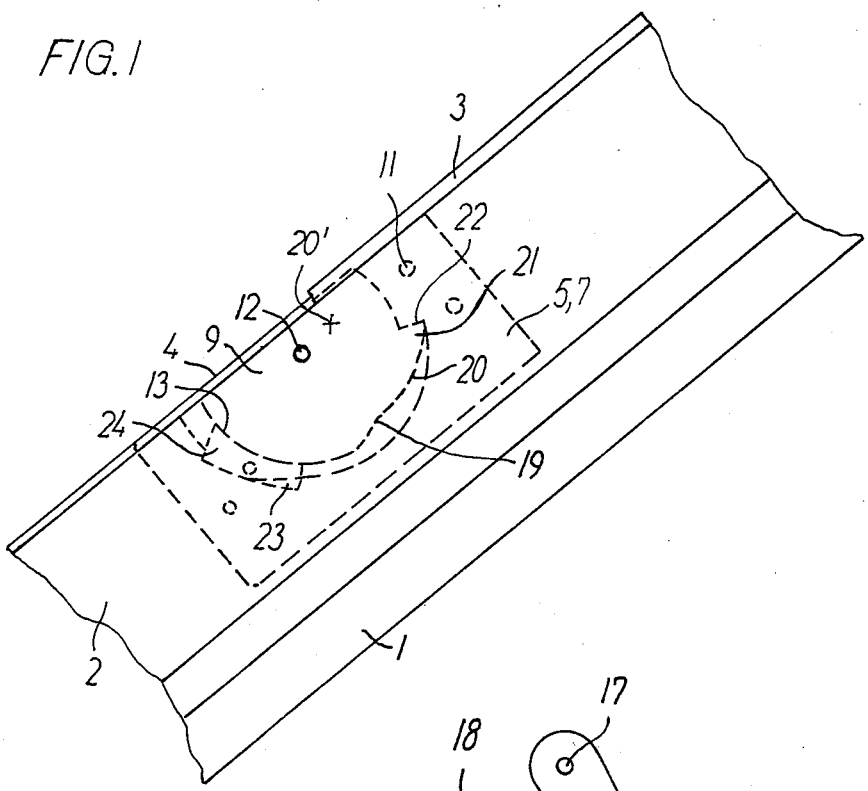
FIGS. 1, 2 and 3 are simplified side views of the central part of an inclined tilting window having a hinge device according to the invention and with the sash in closed, half swung-over and fully swung-over position, respectively.
Figure 2:
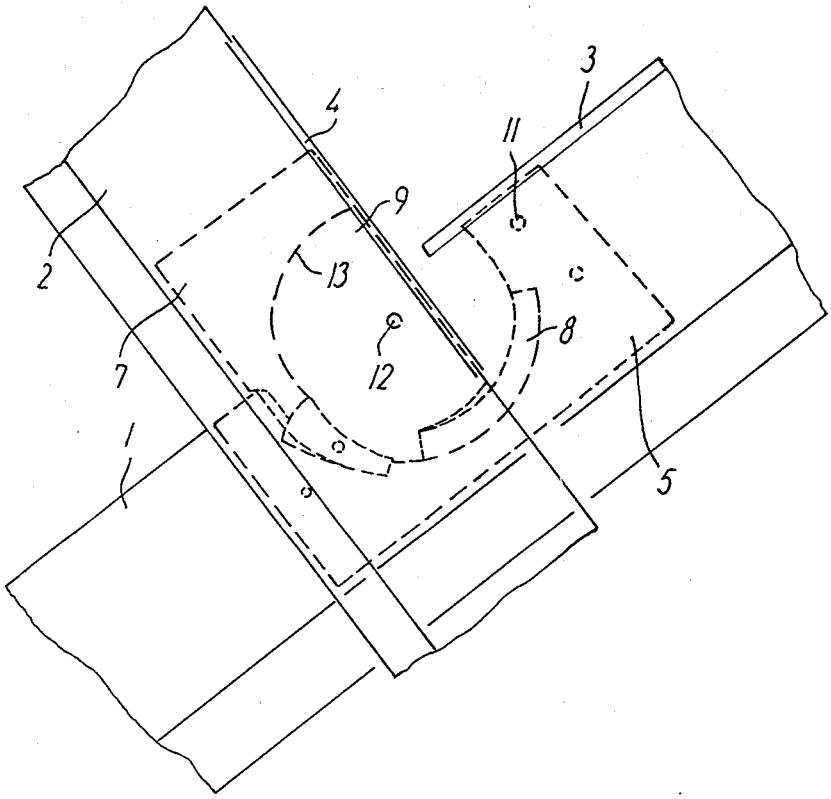
Figure 3:
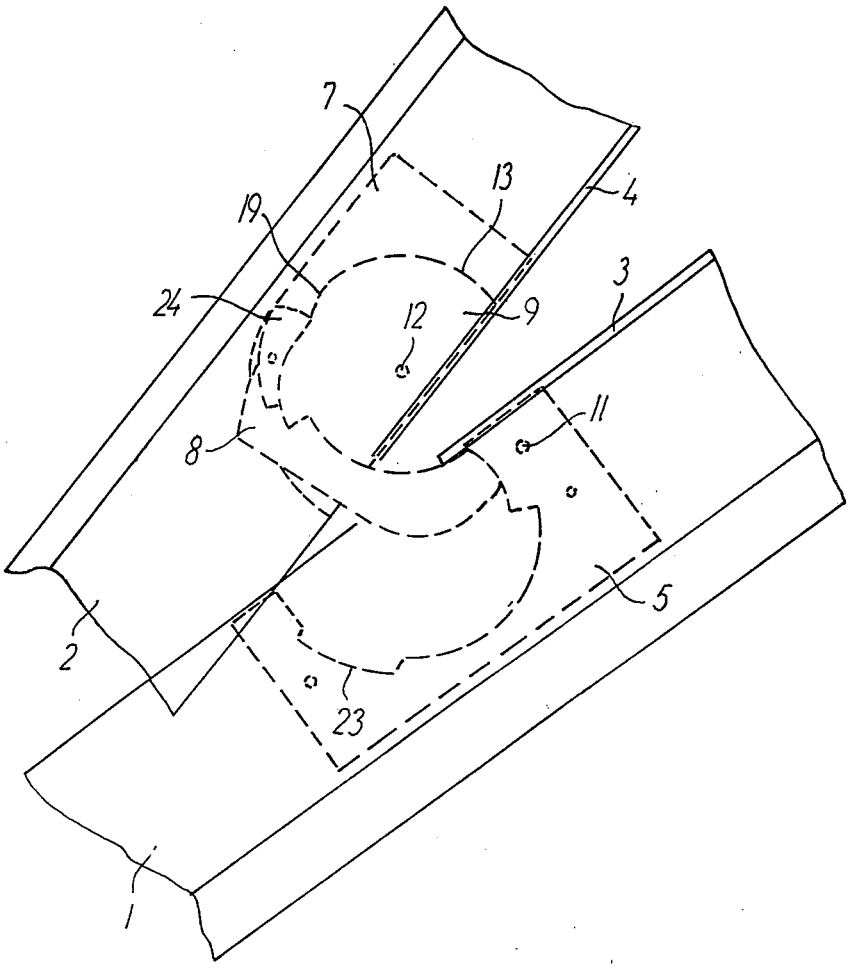

In FIGS. 1–3, 1 and 2 are, respectively, a frame side member and the corresponding sash side member of the window, on which is disposed an ordinary cover rail consisting of an upper section 3 secured to the frame and a lower section 4 secured to the sash. These sections can have any suitable profile and in the closed position, FIG. 1, they overlap each other in the area of the hinge.

Figure 4:
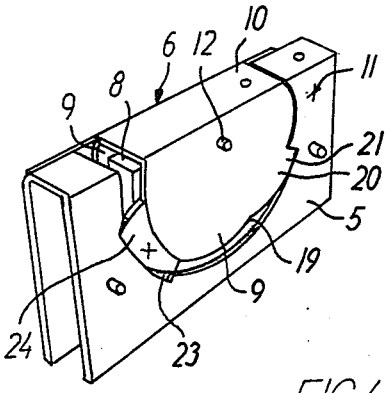
FIGS. 4–9 show the hinge device itself in six different positions from the closed to the fully swung-over position of the sash.

In the shown embodiment, the hinge device comprises a box-shaped frame part 5 which can be secured by screws in a recess of the frame side member 1, a sash part 6 having a base plate 7 to be secured by screws to the sash side member 2, and an intermediate part 8. The three parts or elements as shown are made of punched metal plate but they can also be cast. Besides the base plate 7, the sash part 6 comprises two identical and parallel plates 9 fundamentally shaped as a circle sector of a little more than 180° and interconnected through a front edge wall 10. The plates 9 lie flush with the side walls of the frame part 5, said walls having recesses of approximately the same contour as the plates and in which said plates are received in the closed position of the hinge, FIGS. 1 and 4. Above these recesses and in the vicinity of the front edge, the frame part is provided with a pivot pin 11, and a pivot pin 12 parallel thereto is located in the sash part 6 in the center of an arc-shaped lower section 13 of the contour of the plates 9.

Figure 10:
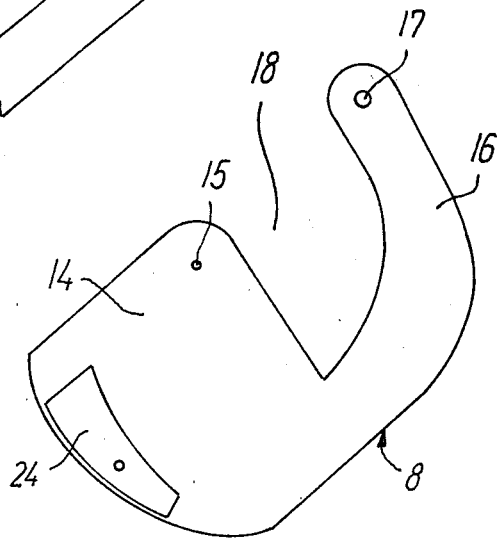
FIG. 10 is a side view of the intermediate part of the hinge device.

The intermediate part 8 has the same thickness as the spacing between the plates 9 and between the side walls of the frame part 5, and its shape will appear most clearly from FIG. 10. This shape may be described as being composed of a circle sector 14 having its centre in a bearing opening 15 for the pivot pin 12 of the sash part, and a curved arm 16 having a bearing opening 17 for the pivot pin 11 of the frame part. In the closed position, FIGS. 1 and 4, the circle sector 14 is positioned in its entirety between the two plate members 9 of the sash part, while the arm 16 is positioned partly between the same plate members and partly between the side walls of the frame part 5. Between the circle sector 14 and the arm 16, the intermediate part is provided with a recess 18 open to the front edge.

The arc-shaped part 13 of the contour of the plates 9 is followed by a valley 19, followed again by a curved guiding surface 20 which may have the same radius as the arc-shaped part 13 but has its center at 20', FIG. 1, spaced above the pivot pin 12. The curved surface 20 is terminated by a nose 21 which, in the closed position, is stopped by an abutment 22 on the frame part 5. The contour of said frame part may, from the abutment 22 and downward, follow a circular arc having a pocket 23 giving room for a rocking latch 24 mounted on the intermediate part 8 and whose inner edge follows a circular arc of the same radius as the edge sections 13 and 20 of the plates 9.

Figure 8:
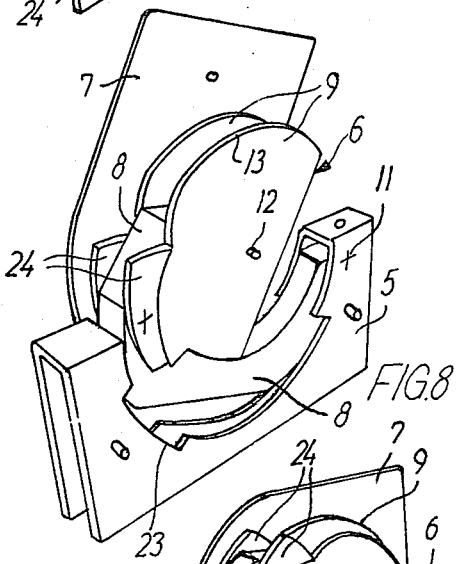
Figure 6:
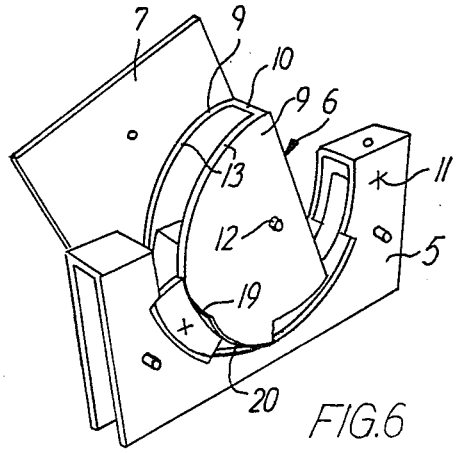
Figure 9:
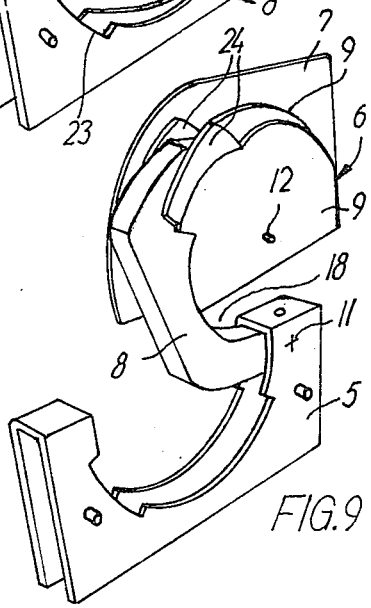

At the beginning of the opening movement of the sash 2, its hinge part 6 rotates about the pin 12 in relation to the intermediate part 8. During this movement the arc-shaped edge section 13 slides along the inner edge of the latch 24 which thereby is held in the pocket 23 and consequently prevents a rotation of the intermediate part 8 about the pin 11, and the edge recess 18 provided in the intermediate part gives room for the upper end of the sash rail section 4 which thereby is disengaged from the frame rail section 3, FIG. 2. After some rotation the curved surface 20 reaches the tail of the latch 24, FIGS. 6 and 7, which is thereby released from the pocket 23 by a rocking motion that is made possible by the valley 19 in the plate 9. In this situation the sash 2 occupies the position shown in FIG. 2 and a continued swinging action on the sash will then result in its rotating together with the intermediate part 8 about the pin 11 in relation to the frame part 5, FIGS. 8 and 9, until the sash reaches the position shown in FIG. 3, where the outer side of the window pane is easily accessible for cleaning. During this last-mentioned swinging, the sash part 6 of the hinge device and the intermediate part 8 should not be mutually rotated, since this would make it difficult to close the window, and consequently, a suitable friction should be provided between the two hinge parts, as explained above. For this purpose, the circle sector 14 of the intermediate part may be provided on at least one lateral surface with a friction coating (not shown), and the plates 9 may be arranged so as to be pressed more or less firmly against the circle sector, for example by using the pivot pin 12 as a tightening screw.

Figure 7:
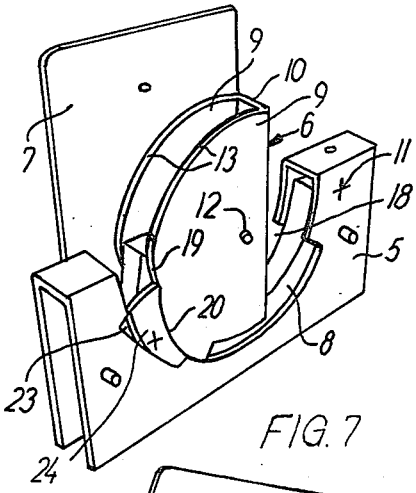
Figure 5:
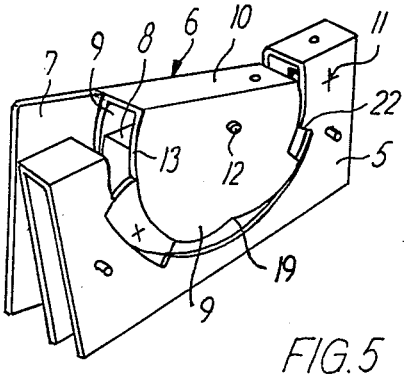

On reclosing of the window, the intermediate part 8 is first rotated back to its place in the frame part 5, i.e. to the position shown in FIGS. 2 and 7, and then the sash is rotated further about the pin 12, whereby the latch 24 serving as a blocking member is again tilted into the pocket 23 and relocks the intermediate part to the frame part 5 of the hinge device.

The latch 24 may possibly be double-acting, so that in one of its extreme positions it arrests the intermediate part in relation to the frame part, as explained above, and in its other extreme position it prevents a rotation of the sash part in relation to the intermediate part. Other single or double-acting arresting mechanisms may also come into consideration, for instance, such mechanisms provided with an arresting pin parallel to the pivot pins 11 and 12 and also controlled forcedly in analogy with the latch 24 as shown.

I claim:

1. A hinge device for tiltable windows including a frame and a sash and having external cover rails positioned on the frame and sash members of the window, respectively, and overlapping each other at the hinge area in the closed position of the window, said hinge device comprising frame and sash parts intended for being firmly secured to the frame member and the sash member, respectively, and an intermediate part connecting said frame and sash parts, the sash part during the movement of the sash from its closed position being successively pivotable in relation to the frame part about a first axis defining a rotation of the intermediate part in relation to the frame part and a second axis defining a rotation of the sash part in relation to the intermediate part, said first and second axes being constituted by two pivot pins connecting the intermediate part with the frame part and the sash part at points above and below, respectively, an edge recess provided in the intermediate part and giving room for the overlapping end of the sash cover rail when the sash part is rotated in the opening direction in relation to the intermediate part, said intermediate part during the tilting of the sash away from its closed position being held against rotation in relation to the frame part until the rotation of the sash part in relation to the intermediate part has been terminated.

2. A hinge device according to claim 1, wherein the intermediate part carries an arresting device which by contact with the sash part is movable between a locking position and a free position in relation to an abutment on the frame part in such a manner that said arresting device only occupies its free position when the rotation of the sash part in the opening direction in relation to the intermediate part has been terminated.

3. A hinge device according to claim 2, wherein said arresting device comprises a latch pivotably mounted on the intermediate part and controlled by contact with a curved surface on the sash part so as to be releasably received in a pocket provided in the frame part.

4. A hinge device according to claim 1, wherein the sash part and the intermediate part are in permanent mutual surface contact in at least one plane at right angles to their mutual rotation axis.

5. A hinge device according to claim 1, wherein the sash part comprises two parallel plates which are positioned on either side of the intermediate part and are variably pressed against said part.

* * * * *